US007125009B2

(12) United States Patent
McCann

(10) Patent No.: US 7,125,009 B2
(45) Date of Patent: Oct. 24, 2006

(54) DOOR CLAMP

(76) Inventor: Gerald McCann, 16 Hammill Glen, Belfast (GB) BT11 8SN ( * ) Notice: Subject to any disclaimer, the term of this patent is extended or adjusted under 35 U.S.C. 154(b) by 18 days.

(21) Appl. No.: 10/514,655

(22) PCT Filed: May 14, 2003

(86) PCT No.: PCT/EP03/05227

§ 371 (c)(1),
(2), (4) Date: Nov. 15, 2004

(87) PCT Pub. No.: WO03/095149

PCT Pub. Date: Nov. 20, 2003

(65) Prior Publication Data

US 2005/0173854 A1 Aug. 11, 2005

(30) Foreign Application Priority Data

May 14, 2002 (GB) ..... 0210966.8

(51) Int. Cl.
*B25B 1/08* (2006.01)

(52) U.S. Cl. ..... 269/234

(58) Field of Classification Search ..... 269/234, 269/133, 274, 296, 906, 43
See application file for complete search history.

(56) References Cited

U.S. PATENT DOCUMENTS 1,404,275 A * 1/1922 Cowles ..... 269/234
1,619,144 A 3/1927 McMillan
2,344,064 A 3/1944 Schueler
2,612,917 A 10/1952 Nelson et al.
3,322,422 A 5/1967 Harvill
5,513,836 A 5/1996 Hillenburg

FOREIGN PATENT DOCUMENTS

CA 1194047 9/1985
GB 2275880 9/1994

* cited by examiner

*Primary Examiner*—Robert C. Watson
(74) *Attorney, Agent, or Firm*—Van Dyke, Gardner, Linn & Burkhart, LLP

(57) ABSTRACT

A clamp holding an object such as a door. The clamp comprises a body shaped to define a recess for receiving a portion of the object, and a wedge which is movable within the recess in order to clamp the object, between the wedge and the body. The wedge and the body are coupled together by means of a coupling mechanism which allows the wedge to adopt a use state, in which the wedge may be moved through the recess, and a storage/transport state in which the wedge is generally co-planar with the body. In the preferred embodiment, the coupling mechanism comprises a guide member mated with an elongate aperture.

21 Claims, 3 Drawing Sheets

DOOR CLAMP

FIELD OF THE INVENTION

The present invention relates to a clamp, or vice, and in particular a clamp for holding an object, such as a door or the like, in an otherwise freestanding state.

BACKGROUND TO THE INVENTION

UK Patent GB 2,275,880 describes a door vice for clamping a door such as to support the door in an otherwise freestanding, upright position. Once held in this position, various operations can then be carried out with greater ease, for example planing an edge of the door, or fitting hinges thereto, etc. The door vice of GB 2,275,880 comprises a cradle having a housing in which a wedge may be seated. During use the edge of a door is seated within the housing beside the wedge, the thick end of the wedge then being driven inwardly of the housing such as to clamp the door between the cradle and the wedge. The side wall of the housing with which the wedge is in contact is obliquely disposed to the transverse axis of the cradle so that the face of the wedge which contacts the door is disposed substantially parallel to the door, thereby achieving the maximum contact therewith.

The door vice of GB 2,275,880 would generally be used by tradesmen and would normally form part of a large selection of tools which are transported from site to site. As a result, the cradle and/or the wedge would often become misplaced, thereby rendering the door vice inoperable.

SUMMARY OF THE INVENTION

According, the present invention provides a clamp for holding an object, the clamp comprising: a body shaped to define a recess for receiving a portion of the object; and a wedge movable within the recess in order to clamp the object between the wedge and the body, characterised in that the wedge is coupled to the body.

Preferably, the clamp includes a coupling mechanism which, with the wedge in a use state, holds at least part of the wedge within the recess and which allows the wedge to be slidably moved through the recess in a first direction.

More preferably, the coupling mechanism allows the wedge to be removed from the recess in a second direction, the second direction being substantially perpendicular with said first direction, and to be rotated about an axis which lies substantially in said second direction, thereby adopting a transport/storage state.

Preferably, the coupling mechanism comprises a slot formed in one of said wedge or body, and a guide member provided on the other of said wedge or body, at least part of the guide member being located in the slot.

More preferably, the slot is formed in the wedge and the guide member is provided on the body.

Further preferably, the slot comprises an elongate aperture formed in the wedge.

Preferably, the guide member is located in the recess.

Preferably, said guide member comprises a guide rod whose longitudinal axis is substantially disposed in said second direction.

Preferably, with the wedge in the use state, the relative dimensions of the wedge and the guide member are such that a free end of the guide member protrudes from the slot.

More preferably, the guide member is dimensioned so that, when the wedge adopts the storage/transport state, the guide member is located in the slot.

Further preferably, with the wedge in the storage/transport state, the free end of the guide member protrudes from the slot.

Preferably, said free end of the guide member is arranged to receive a fastening device for fixing the wedge relative to the guide member.

Preferably, the recess is defined by a first wall and a second wall, the first wall being substantially parallel with said first direction and the second wall being obliquely disposed to said first direction at an angle which substantially matches the shape of the wedge.

More preferably, the coupling mechanism is arranged to hold a side of the wedge substantially in face-to-face engagement with said second wall so that, as the wedge is moved through the recess in said first direction, the opposite side of the wedge is maintained substantially parallel with the first wall of the recess.

Further preferably, said slot is substantially parallely disposed with respect to said other side of the wedge.

Preferably, the wedge has a substantially right angle triangle shaped transverse cross-section.

Preferably, the body is generally planar in form and, when in the storage/transport state, the wedge is generally coplanar with the body.

Preferably, at least one foot is provided on the body, the foot being pivotable between a use state, in which it is substantially perpendicular with respect to the body, and a non-use state in which it is generally coplanar with the body.

Other advantageous aspects and features of the invention will become apparent to those ordinarily skilled in the art upon review of the following description of the specific embodiment.

BRIEF DESCRIPTION OF THE DRAWINGS

An embodiment of the present invention will now be described by way of example and with reference to the accompanying drawings, in which.

DETAILED DESCRIPTION OF THE DRAWINGS

Figure 2:
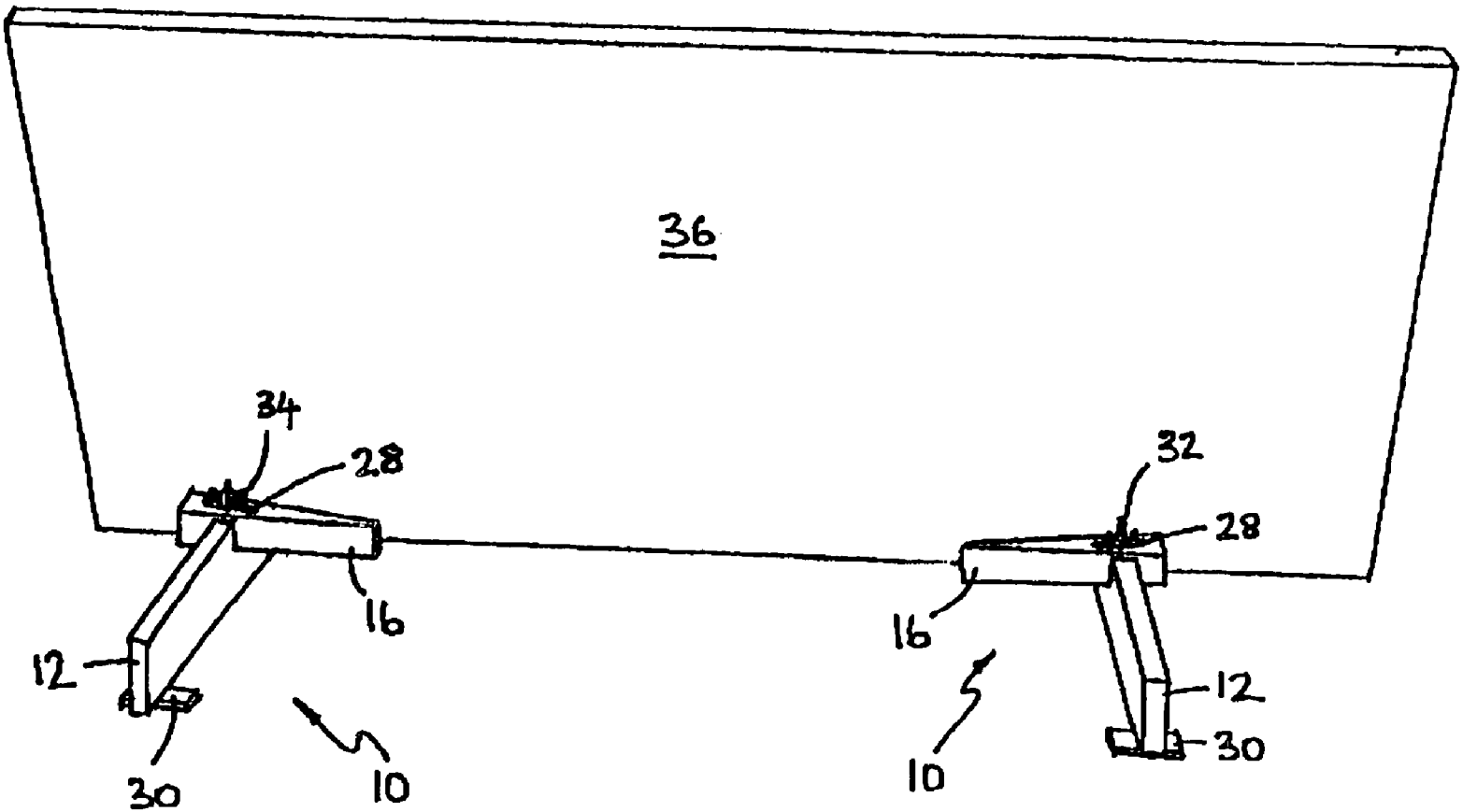
FIG. 2 illustrates a perspective view of a door held in an upright position by two of the clamps of FIG. 1.

Referring now to the accompanying drawings, there is illustrated a preferred embodiment of a clamp, generally indicated as 10, for securing an object such as a door 36 in an otherwise freestanding state. In FIG. 2, the door 36 is shown held in an upright position. The clamp 10 comprises a body 12 having a recess 14 formed therein, and a wedge 16 which is movable within the recess 14 in order to clamp the door 36 within the recess 14. The body 12 and wedge 16 may be formed form any suitable material, but are most preferably formed from a semi-soft material such as wood, plastics or the like which are less likely to damage the door 36.

Figure 1:
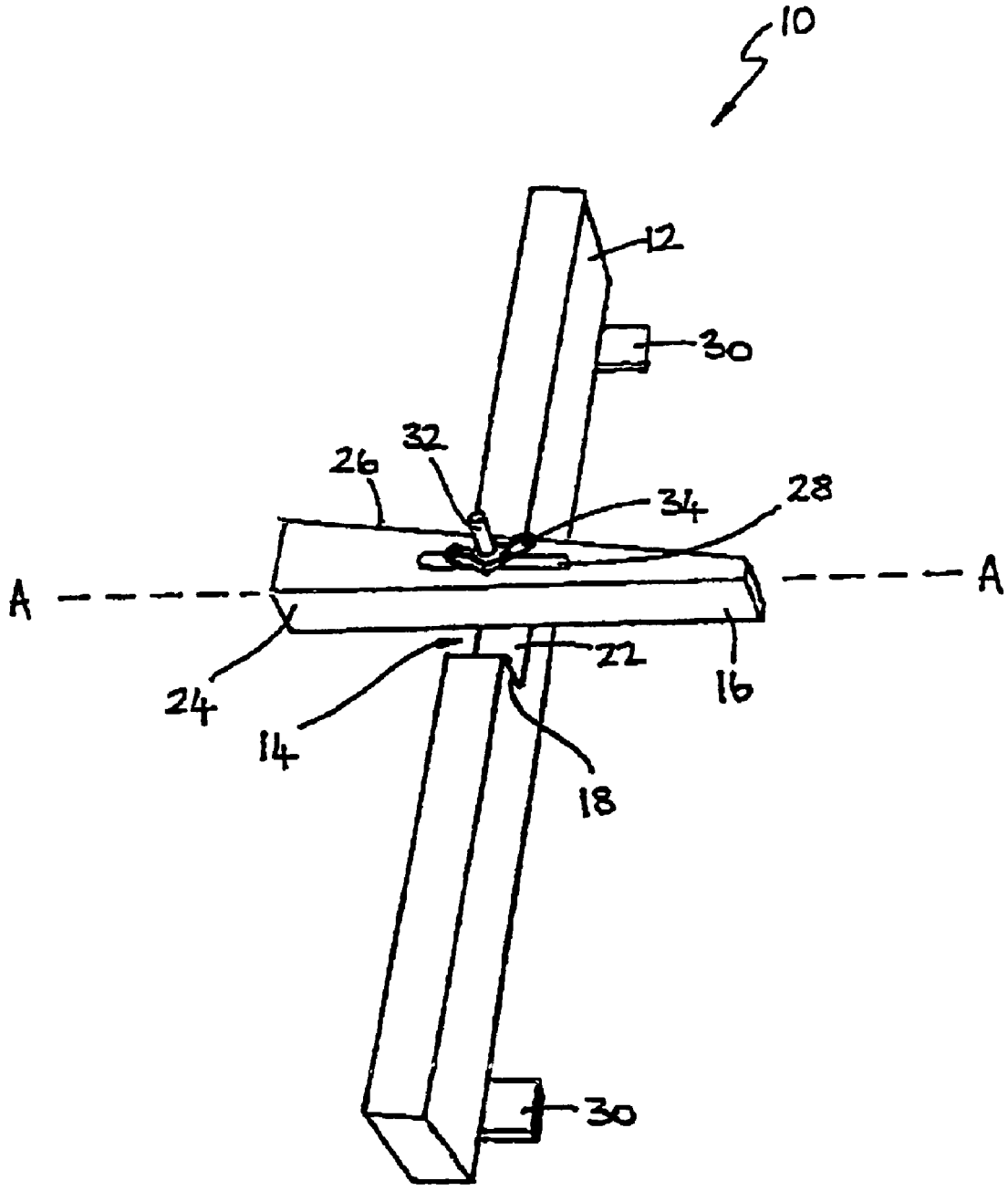
FIG. 1 illustrates a perspective view of a clamp embodying the present invention in a use state.
Figure 3:
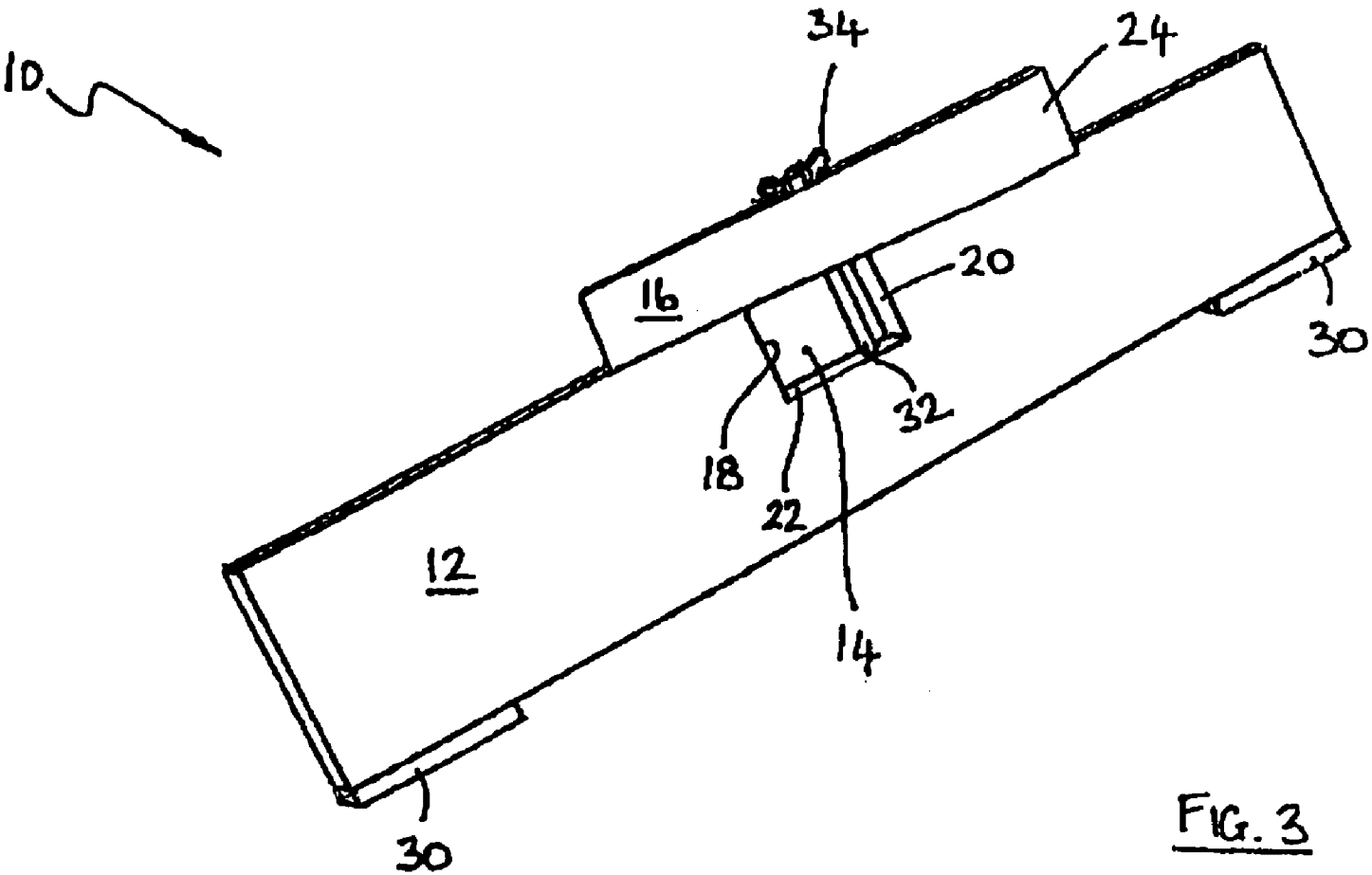
FIG. 3 illustrates a perspective view of the clamp of FIG. 1 in a storage/transport state.

The recess 14 is conveniently, but not necessarily, of a depth equal to that of the wedge 16, so that the wedge 16 sits substantially flush within the recess 14 when located therein (FIGS. 1 and 3). The wedge 16 has a first side 24 and second side 26 disposed at an acute angle thereto, so that at least a part of the wedge 16 is generally triangular or tapered in transverse cross-section. Preferably, at least part of the wedge 16 is substantially the shape of a right-angled triangle in transverse cross-section. In the illustrated embodiment, the wedge 16 has a generally right-angled triangle shaped transverse cross-section in which the second side 26 defines the hypotenuse.

The recess 14 is defined by a first wall 18 against which, in use, the door 36 is seated; a second wall 20 against which the wedge 16 is seated and slides relative to; and a base 22 on which, in use, the wedge is seated and slides relative to. The first wall 18 is preferably substantially perpendicularly disposed with respect to the longitudinal axis of the body 12, i.e. substantially parallel with a transverse axis of the body 12. The second wall 20 is preferably disposed at an angle to a transverse axis (shown as dashed line A in FIG. 1) of the body 12 substantially matching the acute angle defined by the wedge 16 so that when one of the first side 24 or second side 26 of the wedge 16 is in face to face engagement with the second wall 20, the other of the first side 24 or second side 26 will be disposed substantially parallel with the first wall 18, and thus with the face of the door 36 against which the wedge 16 engages in use. This orientation of the wedge 16 is maintained as the wedge 16 is moved through the recess 14 in a direction transverse to the body 12.

The wedge 16 is coupled, or connected, to the body 12 by means of a coupling mechanism. In the preferred embodiment, the coupling mechanism comprises an elongate slot 28, or aperture, formed in the wedge 16 and a guide member 32 provided on the body 12. In the use state (as illustrated in FIGS. 1 and 2), the guide member 32 is located in, or mated with, the slot 28 so that the wedge 16 is seated in the recess 14 and is movable, or slidable, relative to the body 12. The arrangement is such that the wedge 16 is movable through the recess 14 in a direction generally transverse of the body 12. Preferably, the slot 28 is substantially parallely disposed with whichever side 24, 26 of the wedge 16 faces, in use, the first wall 18 of the recess 14. This ensures that the wedge 16 is movable through the recess 14 in a direction substantially parallel with transverse axis A and such that the side 24, 26 of the wedge 16 which faces the door 36 is maintained substantially parallel therewith.

The guide member 32 may take the form of a rod or bar as shown in the drawings. Advantageously, the guide member 32 is located in the recess and disposed substantially perpendicularly to both the transverse and longitudinal axes of the body 12. In the drawings, the guide rod 32 is fixed to the body 12 at the base 22 of the recess 14 and projects perpendicularly therefrom.

The guide rod 32 is preferably positioned proximal the second wall 20 such that, with the guide rod 32 located within the slot 28, one or other of the first side 24 or second side 26 is maintained in face-to-face engagement with the second wall 20 of the recess 14. Consequently a gap is maintained between the wedge 16 and the first wall 18, into which gap the door 36 may be inserted for clamping. The thick end of the wedge 16 may then be driven towards the recess 14, in order to clamp the door 36 between the wedge 16 and the first wall 18 of the recess 14. Hence the slot 28 and guide rod 32 arrangement serves not only to keep the wedge 16 and body 12 together, but also as a guide for the wedge 16.

In the preferred embodiment, the slot 28 is formed fully through the wedge 16 so that the guide rod 32 may pass through the wedge 16 with a free end projecting out of the slot 28. The free end of the guide rod 32 is advantageously provided with means for receiving a fastening member. For example, in the drawings, the free end of the guide rod 32 is threaded and is able to receive a fastening member in the form of a nut 34. By threading a nut, preferably a wingnut 34, onto the guide rod 32 once the wedge 16 has been seated within the recess 14, the wedge 16 may not be disengaged from the guide rod 32. Hence, the body 12 and wedge 16 are maintained in connection with one another. Further, once the door 36 has been suitably clamped between the wedge 16 and the body 12, the wingnut 34 may be tightened against the wedge 16 so as to maintain the clamping action of the clamp 10 on the door 36. The wedge 16 can thus maintain a suitable clamping force on the door 36 regardless of the nature and/or severity of the operations being carried out on the door 36.

In the preferred embodiment, the coupling mechanism is arranged to allow the clamp 10 to adopt a storage/transport state in which the wedge 16 is generally coplanar with the body 12. This may be achieved by dimensioning the guide rod 32 to allow the wedge 16 to be located out of the recess 14 while a portion of the guide rod 32 remains in the slot 28. Thus, referring in particular to FIG. 3, with the nut 34 located adjacent the free end of the guide rod 32 (or removed altogether), the wedge 16 may be drawn out of the recess 14, and then rotated about the guide rod 32 so as to lie substantially co-planar with the body 12. Advantageously, the guide rod 32 is sufficiently long to allow the nut 34 to be fastened thereon when the wedge 16 is in the storage/transport state. The nut 34 may therefore be used to maintain the clamp 10 the storage state. It will be apparent that the storage and transport of the clamp 10 is greatly facilitated when in the storage/transport state. In order to revert the clamp 10 to its use state, the wingnut 34 is simply loosened, the wedge 16 rotated by approximately 90 degrees, and dropped downwardly into the recess 14.

The body 12, in the preferred embodiment is substantially planar in form, primarily for ease of transport and/or storage. In order to increase the stability, in use, of the clamp 10, there are advantageously provided a two or more feet 30 pivotally mounted to the in-use underside of the body 12. In use, the feet 30 may be disposed substantially transverse to the body 12 (as shown in FIG. 1) so as to lend stability to the clamp 10. When the clamp 10 is not in use, each foot 30 may be rotated so as to lie substantially co-planar with the body 12, as illustrated in FIG. 3. It will be appreciated that the feet 30 are not essential to the operation of the clamp 10.

FIG. 2 shows two spaced-apart clamps 10 holding a door 36 in a generally upright freestanding state. Depending on the size of the door 36 and the clamp 10, one clamp 10 may be sufficient, or more than two may be required.

It will be understood that the clamp 10 is not limited to use with doors, or even to use with generally planar objects.

The invention is not limited to the embodiment described herein, which may be amended or modified without departing from the scope of the present invention.

The invention claimed is:

1. A clamp for holding an object, the clamp comprising: a body shaped to define a recess for receiving a portion of the object; a wedge movable within the recess in order to clamp the object between the wedge and the body, characterised in that the clamp includes a coupling mechanism which, with the wedge in a use state, holds at least part of the wedge within the recess and which allows the wedge to be slidably moved through the recess in a first direction, wherein said recess is defined by a first wall and a second wall, said first wall being substantially parallel with said first direction and said second wall being obliquely disposed to said first direction at an angle which substantially matches the shape of said wedge and wherein the coupling mechanism allows the wedge to be removed from the recess in a second direction, the second direction being substantially perpendicular with said first direction, and to be rotated about an axis which lies substantially in said second direction, thereby adopting a transport/storage state.

2. A clamp as claimed in claim 1, wherein the coupling mechanism comprises a slot formed in one of said wedge or body, and a guide member provided on the other of said wedge or body, at least part of the guide member being located in the slot.

3. A clamp as claimed in claim 2, wherein the slot is formed in the wedge and the guide member is provided on the body.

4. A clamp as claimed in claim 3, wherein the slot comprises an elongate aperture formed in the wedge.

5. A clamp as claimed in claim 3, wherein the guide member is located in the recess.

6. A clamp as claimed in claim 2, wherein said guide member comprises a guide rod whose longitudinal axis is substantially disposed in said second direction.

7. A clamp as claimed in claim 4, wherein the guide member is located in the recess.

8. A clamp as claimed in claim 3, wherein said guide member comprises a guide rod whose longitudinal axis is substantially disposed in said second direction.

9. A clamp as claimed in claim 4, wherein said guide member comprises a guide rod whose longitudinal axis is substantially disposed in said second direction.

10. A clamp as claimed in claim 9, wherein, with the wedge in the use state, the relative dimensions of the wedge and the guide member are such that a free end or the guide member protrudes from the slot.

11. A clamp as claimed in claim 7, wherein, with the wedge in the use state, the relative dimensions of the wedge and the guide member are such that a free end of the guide member protrudes from the slot.

12. A clamp as claimed in claim 11, the guide member is dimensioned so that, when the wedge adopts the storage/transport state, the guide member is located in the slot.

13. A clamp as claimed in claim 12, wherein, with the wedge in the storage/transport state, the free end of the guide member protrudes from the slot.

14. A clamp as claimed in claim 11, wherein said free end of the guide member is arranged to receive a fastening device for fixing the wedge relative to the guide member.

15. A damp as claimed in claim 1, wherein the coupling mechanism is arranged to hold a side of the wedge substantially in face-to-face engagement with said second wall so that, as the wedge is moved through the recess in said first direction, the opposite side of the wedge is maintained substantially parallel with the first wall of the recess.

16. A clamp as claimed in claim 15, wherein said slot is substantially parallel disposed with respect to said other side of the wedge.

17. A clamp as claimed in claim 1, wherein the wedge has a substantially right angle triangle shaped transverse cross-section.

18. A clamp for holding an object, the clamp comprising: a body shaped to define a recess for receiving a portion of the object; a wedge movable within the recess in order to clamp the object between the wedge and the body, characterised in that the clamp includes a coupling mechanism which, with the wedge in a use state, holds at least part of the wedge within the recess and which allows the wedge to be slidably moved through the recess in a first direction, and wherein the coupling mechanism allows the wedge to be removed from the recess in a second direction, the second direction being substantially perpendicular with said first direction, and to be rotated about an axis which lies substantially in said second direction, thereby adopting a transport/storage state and wherein the body is generally planar in form and, when in the storage/transport state, the wedge is generally coplanar with the body.

19. A clamp for holding an object, the clamp comprising: a body shaped to define a recess for receiving a portion of the object; a wedge movable within the recess in order to clamp the object between the wedge and the body, characterised in that the clamp includes a coupling mechanism which, with the wedge in a use state, holds at least part of the wedge within the recess and which allows the wedge to be slidably moved through the recess in a first direction, and wherein the coupling mechanism allows the wedge to he removed from the recess in a second direction, the second direction being substantially perpendicular with said first direction, and to be rotated about an axis which lies substantially in said second direction, thereby adopting a transport/storage state and wherein at least one foot is provided on the body, the foot being pivotable between a use state, in which it is substantially perpendicular with respect to the body, and a non-use state in which it is generally coplanar with the body.

20. A clamp as claimed in claim 13, wherein said free end of the guide member is arranged to receive a fastening device for fixing the wedge relative to the guide member.

21. A clamp as claimed in claim 18, wherein the recess is defined by a first wall and a second wall, the first wall being substantially parallel with said first direction and the second wall being obliquely disposed to said first direction.

* * * * *